US006314249B1

(12) United States Patent
Lay et al.

(10) Patent No.: US 6,314,249 B1
(45) **Date of Patent: *Nov. 6, 2001**

(54) METHOD FOR OPERATING A HIGH-PERFORMANCE PRINTER OR A COPIER WITH ASSISTANCE GIVEN MALFUNCTIONS

(75) Inventors: Heinrich Lay, Toeging; Volker Warbus, Oberhaching; Karola Scheidig, Pliening, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/704,946

(22) Filed: Nov. 2, 2000

Related U.S. Application Data

(63) Continuation of application No. 09/423,065, filed on Nov. 1, 1999, now Pat. No. 6,185,379.

(30) Foreign Application Priority Data

Apr. 30, 1997 (DE) ..... 197 18 434

(51) Int. Cl.[7] ..... G03G 15/00
(52) U.S. Cl. ..... 399/11; 399/81
(58) Field of Search ..... 399/9, 11, 81

(56) References Cited

U.S. PATENT DOCUMENTS

| | | | |
|---|---|---|---|
| 4,023,901 | 5/1977 | Kulbida et al. | 355/133 X |
| 4,500,971 | 2/1985 | Futaki et al. | 364/513.5 |
| 5,010,551 | 4/1991 | Goldsmith et al. | 371/16.4 |
| 5,055,996 | 10/1991 | Keslowitz | 364/188 |
| 5,210,571 | 5/1993 | Peloquin et al. | 371/16.4 |
| 5,533,193 | 7/1996 | Roscoe | 395/183.15 |
| 5,737,739 | 4/1998 | Shirley et al. | 707/512 |
| 5,774,759 | 6/1998 | Tanaka | 399/8 |
| 6,185,379 * | 2/2001 | Lay et al. | 399/11 |

FOREIGN PATENT DOCUMENTS

| | | |
|---|---|---|
| 0 429 056 A2 | 5/1991 | (EP) . |
| 0 476 681 A2 | 3/1992 | (EP) . |

OTHER PUBLICATIONS

Japanese Abstract, Publication No. 04080076.
Japanese Abstract, Publication No. 08039894.
Japanese Abstract, Publication No. 01146780.
Derwent—Patent Abstract of Japan, JP 08274927 A.
Derwent—Patent Abstract of Japan, JP 56008155 A.

* cited by examiner

*Primary Examiner*—Fred L Braun
(74) *Attorney, Agent, or Firm*—Schiff Hardin & Waite

(57) ABSTRACT

A method for operating a printer or copier provides that error conditions are sensed utilizing monitoring units. A determination is made as to whether the error condition is readily repairable by the user and, if so, the display unit displays information on the error condition including instructions for repairing the error condition. If, on the other hand, the error condition is determined to be repairable only by a skilled technician, the display unit displays only the instructions to contact the skilled technician.

10 Claims, 5 Drawing Sheets

METHOD FOR OPERATING A HIGH-PERFORMANCE PRINTER OR A COPIER WITH ASSISTANCE GIVEN MALFUNCTIONS

CROSS REFERENCE TO RELATED APPLICATION

The present application is a continuation of application Ser. No.: 09/423,065, filed Nov. 1, 1999, now U.S. Pat. No. 6,185,379.

BACKGROUND OF THE INVENTION

1. Field of the Invention

The present invention is directed to a method for operating a high-performance printer or a copier, whereby a plurality of monitoring units sense malfunctions of the high-performance printer or of the copier.

2. Description of the Related Art

A high-performance printer, for example, prints single sheets or web-shaped sheet material at high speed, for example more than 50 pages DIN A4 per minute. In order to assure this high printing speed and the further-processing of the sheet material, a plurality of complex units and control modules are required. Given outage of a single module, operation of the high-performance printer can be so highly disrupted that printing must be stopped. In order to be able to immediately recognize malfunctions, a plurality of monitoring units sense error conditions. One such monitoring unit can, for example, be a simple path switch that recognizes the opened condition of a device. These monitoring units, however, also include complex detector devices that, for example, determine the wear of a unit.

A great number of error conditions, for example more than 300 different error conditions, are possible due to the complexity of the high-performance printer or copier system. In order to eliminate the error conditions, an operator analyzes the error that has occurred and attempts to eliminate the error, for example by replacing parts or undertaking new settings for the high-performance printer. In the prior art, it is standard that the operator is informed about the error condition on a display. The operator can then call a menu at the control panel unit, i.e. the menu being a compilation of texts in a list which the operator references to receive assistance for eliminating the individual errors.

Given the occurrence of relatively serious errors, the operator must have a high degree of training and very good knowledge about the high-performance printer in order to be able to eliminate the error, for example given errors in the transfer printing unit that require the replacement of parts and the re-setting of the transfer printing unit. In order to be able to undertake the measures for eliminating errors, a highly qualified maintenance technician is often called, this person being given technical instructions for eliminating the error on the basis of a technical handbook or, respectively, a maintenance handbook. This technical handbook is indispensable because specific technical specifications of specific high-performance printers are described therein. Since a highly qualified maintenance technician, however, is not always immediately available and, on the other hand, the standstill of the high-performance printer means economic loss, less trained operators often attempt to eliminate the error. Practice has shown that such an elimination of errors frequently leads to greater damage. Further, practice has shown that the technical handbook is not always immediately available and an elimination of errors is initiated without consulting the handbook. Such a procedure also often leads to greater damage.

An object of the invention is to specify a method for the operation of a high-performance printer or of a copier which provides clear and comprehensive assistance for an operator in case of error.

The invention offers a method for operating a high-performance printer or copier, whereby a multitude of monitoring units acquire error statuses of the high-performance printer or copier, a control panel unit that serves for the input of operating instructions and for displaying operating conditions displays these error conditions on a display, the error conditions are divided by a controller into a first error class and into at least one further error class dependent on the seriousness of the error elimination, information are called by actuating an input at the control panel unit given the occurrence of an error condition of the first and of the further class and are displayed on the display, these information containing instructions for error-handling, and whereby the presence of an error condition of the further class is displayed on the display of the control panel unit. In one exemplary embodiment, access to the specific information for error handling of error conditions of the further error class ensues via an access authorization procedure.

The invention is based on the consideration that error conditions that can be eliminated with relatively simple measures should be distinguished from error maintenance technician is often called, this person being given technical instructions for eliminating the error by a technical handbook or, a maintenance handbook. This technical handbook is indispensable because specific technical specifications of specific high-performance printers are described therein. Since a highly qualified maintenance technician, however, is not always immediately available and, on the other hand, the idle high-performance printer results in economic loss, less trained operators often attempt to eliminate the error. Practice has shown that such attempts to fix the problem frequently leads to greater damage. Further, practice has shown that the technical handbook is not always immediately available and attempts to eliminate the errors are initiated without consulting the handbook. Such a procedure also often leads to greater damage.

European Patent Document EP-A-0 429 056 describes a method for operating a copier, whereby a plurality of monitoring units sense error conditions of the copier. These error conditions are communicated to a central control via a long-distance data transmission in the form of signals, this central control outputting these error conditions at a control panel unit having a display. Error conditions can be classified such that, dependent on the seriousness, these error conditions are allocated to a first error class and to at least one second error class. In conjunction with the error conditions and the error classes, an operator can fetch further information with an input into the control panel unit. The information also contain instructions for error handling.

SUMMARY OF THE INVENTION

An object of the invention is to provide a method for the operation of a high-performance printer or of a copier which provides clear and comprehensive assistance for an operator in case of error.

This and other objects are achieved by a method for operating a high performance printer or copier including acquiring the error conditions of a number of monitoring units of the high performance printer or copier, displaying the error conditions on a display unit of a control panel which serves to input the operating instructions and for displaying the operating conditions, dividing the error conditions into a first class and at least a further class by a controller depending upon the difficulty of error elimination, given occurrence of an error condition of the first error class of the further error class, calling for information by actuation of an input to the control panel and displaying on the display unit the instructions for handling that error and displaying the existence of an error condition of the further class on the display of the control panel and requiring an access authorization procedure to be performed to access specific information regarding error handling of an error condition of the further class.

The invention offers a method for operating a high-performance printer or copier, whereby a multitude of monitoring units sense error statuses of the high-performance printer or copier, a control panel unit that serves for the input of operating instructions and for displaying the operating conditions displays these error conditions on a display, the error conditions are divided by a controller into a first error class and into at least one further error class depending on the seriousness of the error elimination, information is called by actuating an input at the control panel unit given the occurrence of an error condition of the first and of the further class and are displayed on the display, the information containing instructions for error-handling, and whereby the presence of an error condition of the further class is displayed on the display of the control panel unit. In one exemplary embodiment, access to the specific information for error handling of error conditions of the further error class ensues via an access authorization procedure.

The invention is based on the consideration that error conditions that can be eliminated with relatively simple measures should be distinguished from error conditions that require serious counter-measures in order to authorize the suitable operating personnel with the error-handling task. Accordingly, the invention provides that the error conditions be divided by a controller into a first error class and into at least one further error class dependent on the seriousness of the error elimination. For error conditions that require technically involved and relatively difficult error-handling measures, only an operator, for example a technician trained with specific courses, should be permitted to undertake the error-handling when this operator has a specific access authorization and successfully passes an access authorization procedure. Only such a qualified operator is informed of further information about the suitable error handling on the basis of a menu mode. In the case of error conditions that belong to the first error class, any operator responsible for the high-performance printer is given assistance via the display unit of the control panel unit and, according, implements the error-handling measures.

It has been shown in practice that an operator of the printer or copier is not overtaxed by the measures of the invention and confusion due to the multitude of technical information and the multitude of error conditions does not occur. Due to the display of clear information about an error condition of the further class, an operator having the appropriate technical capabilities can be called and, as a result thereof, a minimization of damage is also achieved. Overall, faster error-handling occurs due to the method of the invention and the down times for the high-performance printer are reduced.

According to a development of the invention, video data are kept on hand in a memory, these being capable of being accessed under the control of a menu when an error condition occurs, whereby these video data preferably explain the procedures for eliminating an error condition. The procedures for error-handling at the high-performance printer may be difficult because the steps require spatial visual conceptualization of the problem on the part of the operator. Videos of repair activities are therefore prepared and the video data is deposited in a memory. For such activities, the operator can call the video data and have the videos displayed on the display of the control panel unit in order to learn the procedure and to later implement them.

A preferred exemplary embodiment of the invention provides that the data of a technical handbook is kept on hand in a memory to address the problems resulting from the further error class and the handbook data can be retrieved after performing an the access authorization procedure. Such a technical handbook or, a maintenance handbook is indispensable in order to receive detailed technical information at highly complex systems such as, for example, a high-performance printer in the present case. In the exemplary embodiment, the handbook data, for example text data and graphics data, are kept on hand in a memory. These data can be easily modified and thus be adapted to the current technical condition of the high-performance printer or of the copier. On the basis of a menu prompt, the highly qualified operator can call the data of the handbook and carry out the relatively complex measures for error elimination. An operator who has no access authorization cannot retrieve the data of the handbook and is thereby prevented from initiating error-handling measures for which the operator is not sufficiently qualified.

BRIEF DESCRIPTION OF THE DRAWINGS

Exemplary embodiments of the invention are explained below with reference to the drawings.

DETAILED DESCRIPTION OF THE PREFERRED EMBODIMENTS

Figure 1:
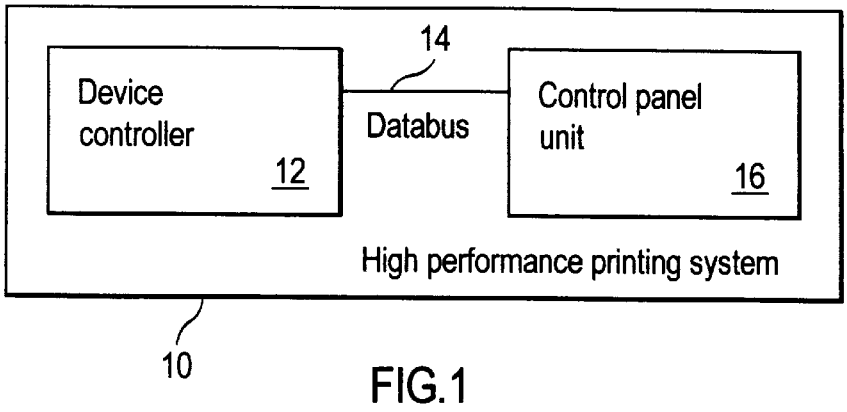
FIG. 1 is a functional block diagram showing the structure of the high-performance printer with the control panel unit.

FIG. 1 schematically shows control parts of a high-performance printer that is composed of a multitude of device components as is known, for example the central printer unit, a paper input unit, a paper output unit, a stacking unit, one or more transfer printing stations, etc. A device controller 12 of the high-performance printer controls the aforementioned components. It is connected to a control panel unit 16 via a data bus 14, for example a V24 interface, this control panel unit 16 being realized by a personal computer. The high-performance printer 10 contains a plurality of monitoring units that signal error conditions of the high-performance printer to the device controller 12.

Figure 2:
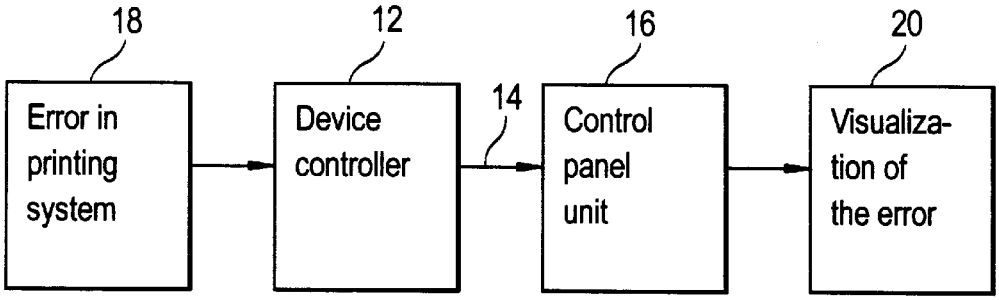
FIG. 2 is a block diagram showing the data transmission from the error location to the control panel unit.

FIG. 2 schematically shows the signaling path from the error location up to the display of the error on the display of the control panel unit 16. A monitoring unit 18 identifies an error in the high-performance printer 10 and signals this error to the device controller 12. Via the data bus 14, the identified error condition is communicated to the control panel unit 16, which displays the type of error on a picture screen 20.

Figure 3:
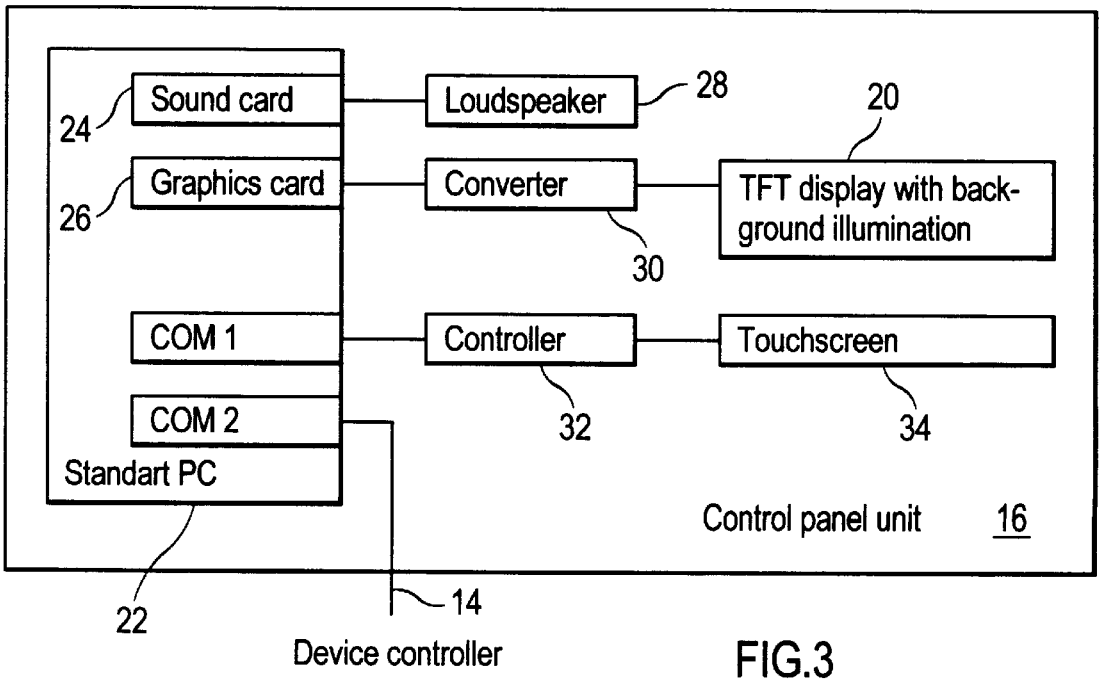
FIG. 3 is a block diagram showing the schematic structure of the control panel unit.

FIG. 3 shows the structure of the control panel unit 16. The crux is a standard personal computer 22 that is equipped with a sound card 24, a graphics card 26 and two interfaces COM1 and COM2. Of course, this personal computer 22 contains further components such as a disk drive, memories, etc. The sound card 24 is connected to a loudspeaker 28 that outputs acoustic information, for example in conjunction with the playback of video data to be described later. The graphics card 26 serves the purpose of fast display of image information on the display unit 20 and is connected thereto via a converter 30.

The display unit 20 is fashioned as TFT display (TFT is an abbreviation for thin film transistor). This TFT display is a special form of a LCD picture screen, whereby thin-film transistors designationally activate and deactivate electrical fields for the polarization of the anisotropic liquid of the LCD elements. With the assistance of TFT technology, a high resolution picture is achieved in view of luminance, color and sharpness.

A touch screen unit 34 is provided for inputting data into the control panel 16, the touch screen unit 34 being connected via a controller 32 to the communication interface COM1. The touch screen unit 34 is mechanically connected to the display 20. When an operator touches a touch-sensitive actuation field of the unit 34, whereby the actuation field coincides with a display field displayed by the display 20, then a switch signal is communicated to the personal computer 22. The personal computer 22 activates a program part on the basis of this switch signal, as a result whereof a menu control or, respectively, the input of acknowledgment signals, numbers and text elements is realized, as known in and of itself. The device controller 12 is connected to the communication interface COM2 via the data bus 14.

Figure 4:
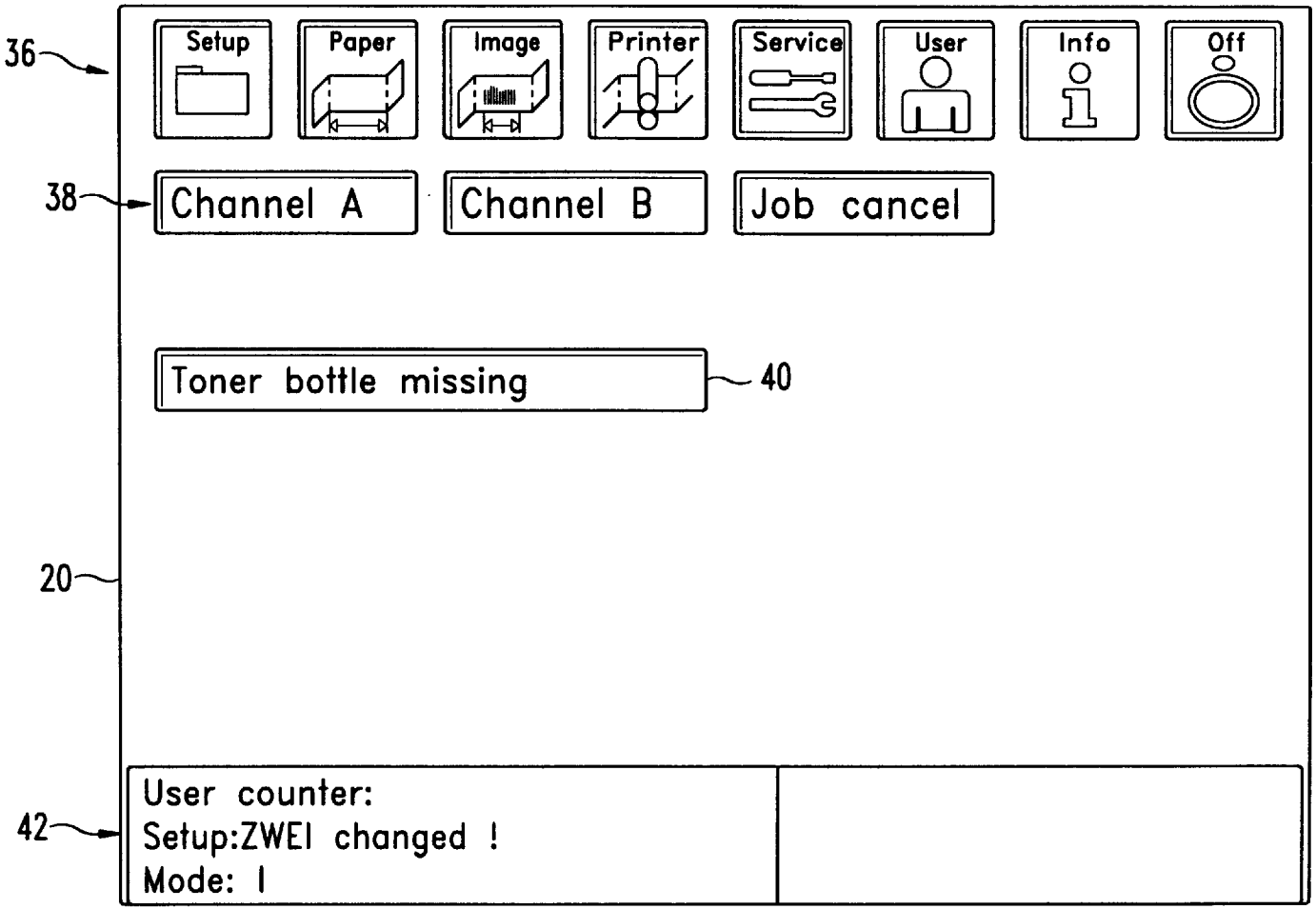
FIG. 4 is a schematic illustration of the display of an error on the picture screen.

FIG. 4 shows the structure of a display on the display unit 20. A plurality of display fields are indicated in the upper line 36, these containing text information and graphic information. The various display fields "setup" through "off" serve the purpose of user prompting. By touching one of these display fields, a switch pulse is triggered by the touch screen function and the personal computer 22 activates an appertaining program part in order to request input data or, respectively, in order to display appertaining texts. Display fields that relate to the interface channel A and the interface channel B are in a second line 38. The printer can be connected to a higher-ranking system via these interface channels. The data to be printed are transferred from the system to the printer via these channels A, B. The display field "job cancel" provides the operator with the possibility of canceling the print job when this field is touched.

One input field 40 is allocated to the display of an error of the high-performance printer 10. In case of an occurring error, a text that indicates the error appears on a red background. By touching this display field 40, a switch signal is triggered via the touch screen function, and the control panel program to be processed in the personal computer 22 branches to a menu program that contains a user interface for error conditions. The lowest line 42 of the illustrated image contains further information that are of no significance here for the description of the invention.

Figure 5:
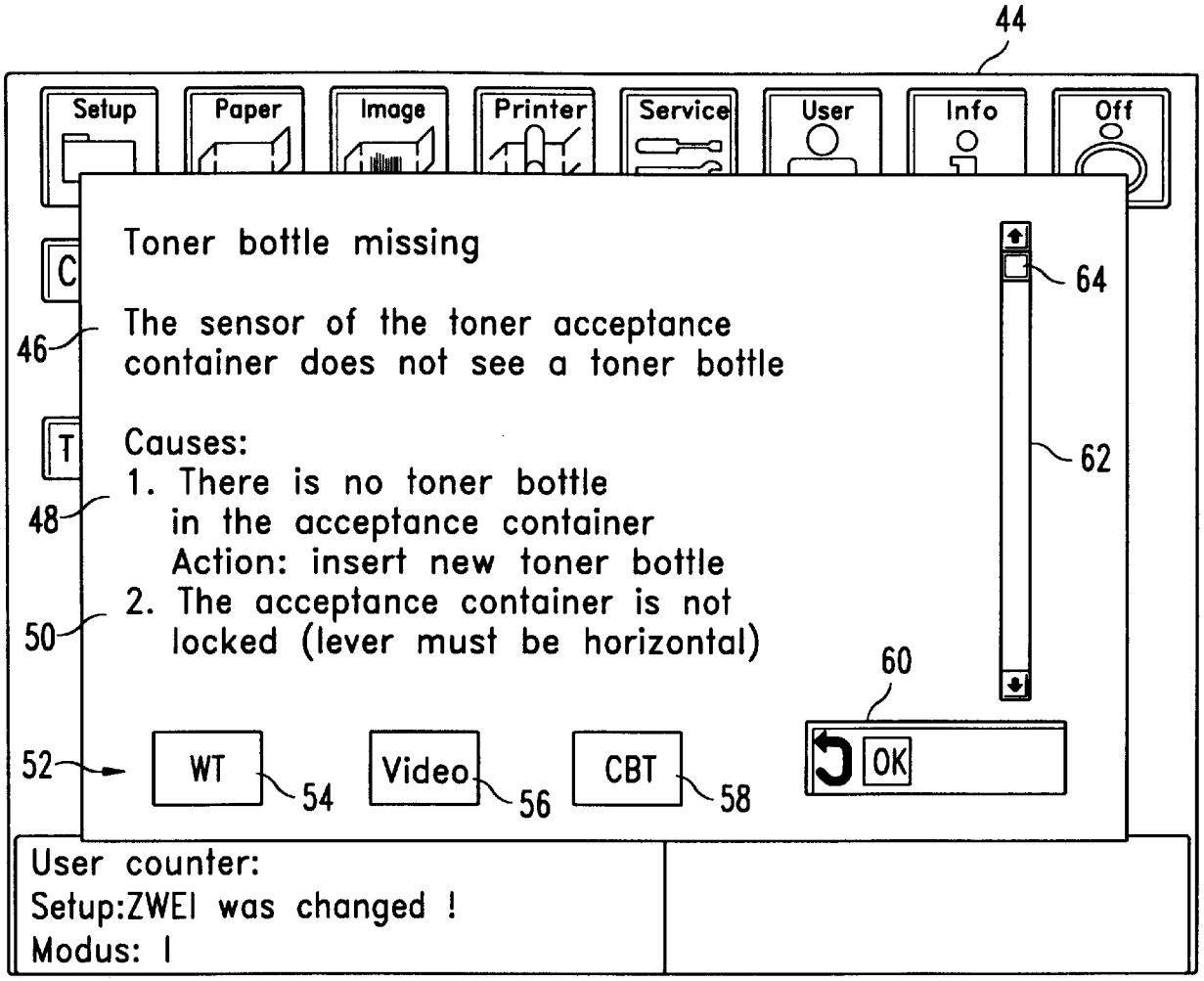
FIG. 5 is a screen display of a help text after actuation of an actuation field.

After touching the actuation field, which coincides with the display field 40, the control panel program calls a display page 44, as shown in FIG. 5. The previous display page shown in FIG. 4 can still be seen on the picture screen in the background. In the illustrated example, a monitoring unit identified "toner bottle missing" as the error condition. The error condition is explained in the text line 46 on the display page 44. The error condition is analyzed in the sections 48 and 50 and an error-elimination measure is indicated.

A plurality of display fields 54 through 60 are indicated in the lowest display line 52. The display field 54 contains the text "maintenance technician". This display field 54 lights up when an error condition of the aforementioned, further error class occurs. In other words, the elimination of the error is comparatively difficult and should only be undertaken by an appropriately skilled technician. When the display field 54 lights up and the congruent actuation field with touch screen function is actuated, then the control panel program branches into a software routine wherein an operator is checked for access authorization. The control panel unit prompts the operator to identify himself and input identification data. These identification data are compared to data of an authorization list that has been previously established in the personal computer 22. When the comparison is positive and the input identification data agree the with data on the authorization list, then the operator receives menu-controlled access to further information, for example to information that is deposited in the maintenance handbook.

A display field 56 having the text "video" lights up when video information is present in the memory of the personal computer 22 for the indicated error condition, preferably on a CD-ROM. By touching the appertaining actuation field, the video data is displayed on the display, for example to illustrate measures for eliminating the error.

A display field 58 contains the text "CBT" which indicates a training program (CBT is an abbreviation for computer based training). By touching the appertaining actuation field, a segment of a training program is called and processed. This segment is preferably allocated to the error condition displayed at the moment. With the assistance of this training program, an operator can be initiated into the correct handling of the error condition. Further, the training program contains exercises for the operating personnel and provides introductions into the structure of the high-performance printer.

A display field 60 serves as an acknowledgment field. By touching the display field 60, a desired function is selected and potentially started. Moreover, the displayed menu window is closed.

Further, the display page 44 contains a scroll bar 62. With the assistance of this scroll bar, a function from various displayed functions can be selected by moving the display element 64, and the selection is acknowledged by actuation of the display field 60.

Figure 6:
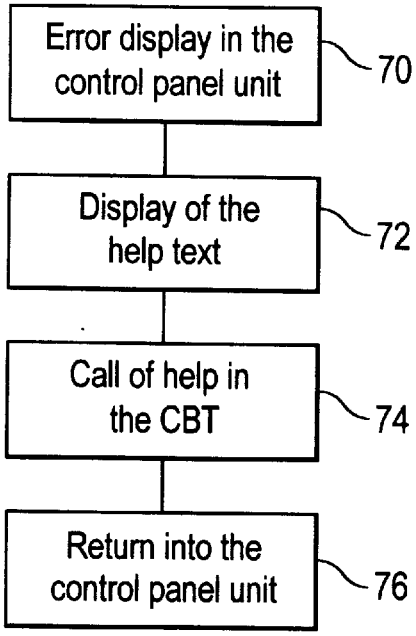
FIG. 6 is a block diagram of the schematic executive sequence for calling a training program.

FIG. 6 schematically shows the executive sequence when calling the training program after actuation of the display field 58 "CBT". As mentioned, a text that provides information about the nature of the error condition appears on the display page 44 (block 70). Further, a display of the help text (block 72) appears. By touching the actuation field 58, information that are offered by the training program are called and displayed (block 74). The operator can subsequently branch back into the initial display, as shown in FIG. 4 (block 76).

Figure 7:
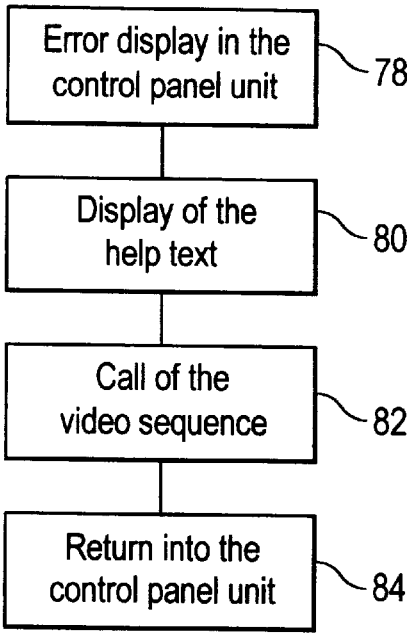
FIG. 7 is a block diagram of the executive sequence when calling a video sequence.

FIG. 7 shows the corresponding executive sequence when calling and displaying a video sequence, whereby the actuation field 56 in FIG. 5 must be actuated by the operator (blocks 78, 80, 82, 84 in FIG. 7).

Figure 8:
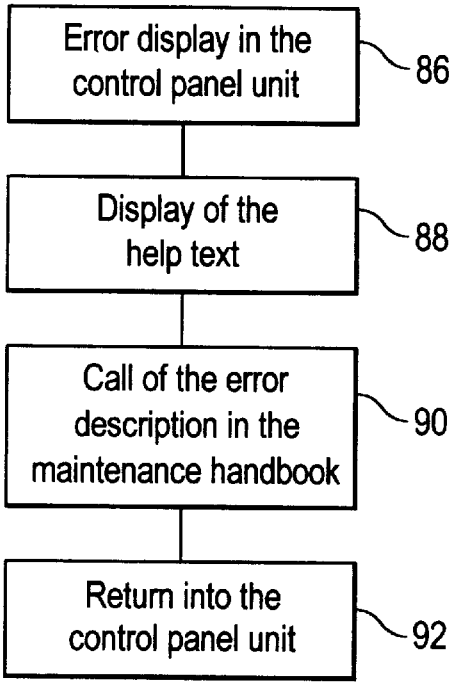
FIG. 8 is a block diagram of the menu-controlled calling for information from the handbook.

FIG. 8 shows the executive sequence when calling the error description and error handling upon utilization of the maintenance handbook (blocks 86, 88, 90, 92). This call only ensues when a qualified operator has documented the required access authorization.

Figure 9:
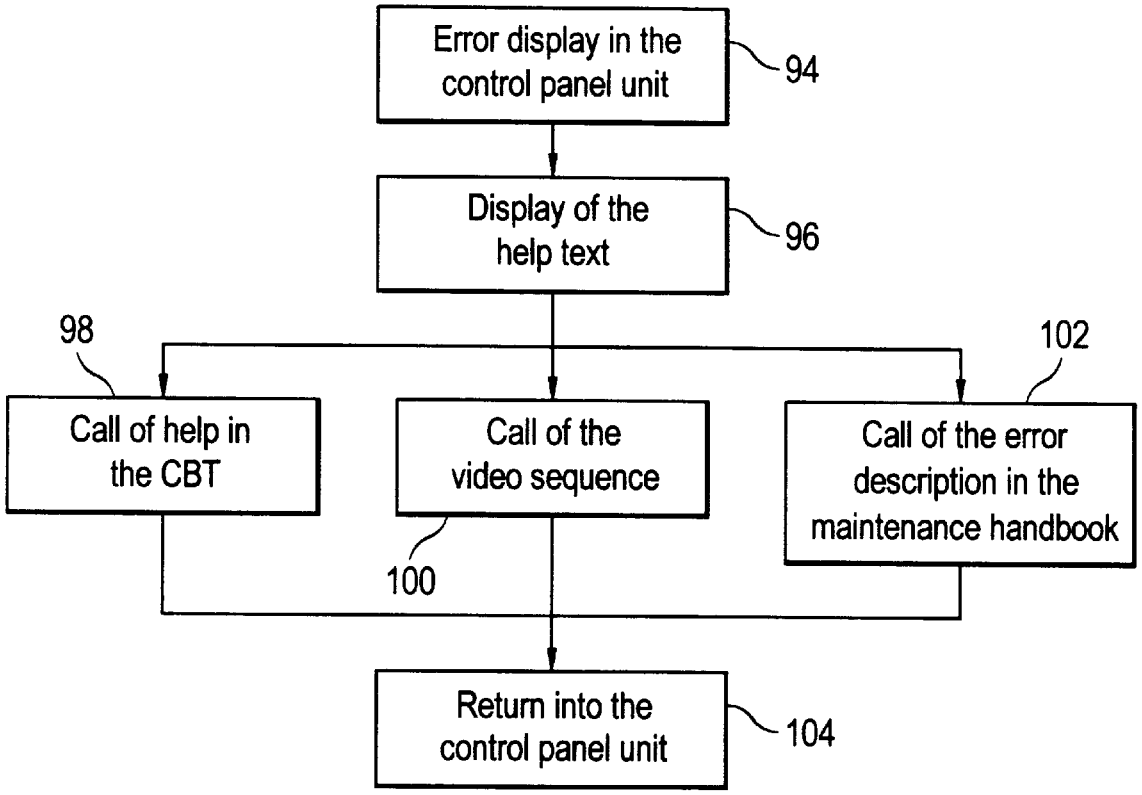
FIG. 9 is a block diagram of an overview of all help services for the operating personnel.

FIG. 9 provides an overview of the various assistance that is offered by the control panel program. First, an error display respectively ensues on the display unit 20 (block 94). Subsequently, a help text is displayed that explains the error condition and potentially indicates the cause of the error (block 96). The operator then has the possibility of calling a training program (block 98) or viewing a video sequence on the display unit 20 (block 100). After passing an access authorization procedure, a qualified operating personnel can also call data from the maintenance handbook in order to receive a more detailed error description as well as indications for more complicated error elimination.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for operating a high-performance printer or a copier, comprising the steps of:

sensing error conditions of the high-performance printer or of the copier using a plurality of monitoring units, displaying the error conditions on a display unit by a control panel unit that serves for input of operating instructions and for displaying operating conditions, dividing the error conditions by a controller into a first error class and at least one further error class dependent on the difficulty of error elimination, given occurrence of an error condition of the first and of the further class, calling information by actuating an input at the control panel unit and displaying the information on the display unit, said information containing instructions for error handling, and displaying existence of an error condition of the further class on the display unit of the control panel unit.

2. A method according to claim 1, further comprising the steps of:

providing a touch screen unit in said control panel unit that displays text and graphics information on a display field and that, by touching displayed actuation fields, displays further, subsequent display fields.

3. A method according to claim 1, further comprising the steps of:

displaying an error condition within an actuation field and identifying the error condition by text.

4. A method according to claim 1, further comprising the step of:

storing help texts in a memory, the help texts being capable of being accessed menu-controlled given occurrence of an error condition.

5. A method according to claim 1, further comprising the step of:

storing a training program on hand in a memory, the training program being capable of being accessed menu-controlled given the occurrence of an error condition.

6. A method according to claim 1, further comprising the step of:

storing video data in a memory, the video data being capable of being accessed menu-controlled given the occurrence of an error condition.

7. A method according to claim 1, further comprising the step of:

using a TFT display as the display unit.

8. A method according to claim 1, further comprising the step of:

storing the training program in the control panel unit, which contains a personal computer, with reference whereto operating personnel is informed by a structure of high-performance printer, a cause of error conditions and a procedure for elimination of errors.

9. A method according to claim 1, further comprising the step of:

connecting a device controller of the high-performance printer via a data bus to the control panel unit; and the device controller reporting the error conditions sensed by the monitoring units to the control panel unit.

10. A method according to claim 1, further comprising the step of:

outputting acoustic information.

* * * * *